US009799250B2

(12) United States Patent
Cho

(10) Patent No.: US 9,799,250 B2
(45) Date of Patent: Oct. 24, 2017

(54) DATA DRIVER

(71) Applicant: SAMSUNG DISPLAY CO., LTD., Yongin, Gyeonggi-do (KR)

(72) Inventor: Dong-Beom Cho, Asan-si (KR)

(73) Assignee: SAMSUNG DISPLAY CO., LTD., Yongin, Gyeonggi-Do (KR)

( * ) Notice: Subject to any disclaimer, the term of this patent is extended or adjusted under 35 U.S.C. 154(b) by 258 days.

(21) Appl. No.: 14/536,025

(22) Filed: Nov. 7, 2014

(65) Prior Publication Data

US 2015/0356910 A1 Dec. 10, 2015

(30) Foreign Application Priority Data

Jun. 9, 2014 (KR) ..... 10-2014-0069745

(51) Int. Cl.
*G09G 3/3275* (2016.01)
*G09G 3/20* (2006.01)

(52) U.S. Cl.
CPC ..... *G09G 3/20* (2013.01); *G09G 3/3275* (2013.01); *G09G 2310/027* (2013.01); *G09G 2310/0275* (2013.01); *G09G 2310/0286* (2013.01); *G09G 2310/0289* (2013.01); *G09G 2310/0291* (2013.01); *G09G 2310/0297* (2013.01)

(58) Field of Classification Search
None
See application file for complete search history.

(56) References Cited

U.S. PATENT DOCUMENTS 6,097,362 A 8/2000 Kim
6,333,725 B1 12/2001 Kim
7,978,188 B2 * 7/2011 Shin ..... G09G 3/3291 345/204
8,274,503 B2 * 9/2012 Kwon ..... G09G 3/3233 345/214
2007/0132621 A1 * 6/2007 Choi ..... G09G 3/3291 341/144
2007/0212078 A1 9/2007 Jo
(Continued)

FOREIGN PATENT DOCUMENTS

KR 1019990031752 5/1999
KR 1020000004305 1/2000
(Continued)

*Primary Examiner* — Seokyun Moon
(74) *Attorney, Agent, or Firm* — F. Chau & Associates, LLC

(57) ABSTRACT

A data driver includes first through n-th shift register units, first through n-th latch units, and first through n-th output buffer units. The first through n-th shift register units shift and store a plurality of image output from a timing controller. The first shift register unit includes first through m-th shift registers. The first through m-th shift registers shift and store first through m-th image data among the plurality of image data. The first through n-th latch units are connected to the first through n-th shift register units, respectively. The first latch unit includes first through m-th latches. The first through n-th output buffer units are connected to the first through n-th latch units, respectively. The first output buffer unit includes first through m-th output buffers. The first through n-th latch units sequentially latch the plurality of image data stored in the first through n-th shift register units.

15 Claims, 5 Drawing Sheets

(56) References Cited

U.S. PATENT DOCUMENTS

| | | | | |
|---|---|---|---|---|
| 2008/0150874 | A1* | 6/2008 | Kida | G09G 3/3688 345/100 |
| 2009/0066686 | A1* | 3/2009 | Ryu | G09G 5/395 345/213 |
| 2009/0153546 | A1* | 6/2009 | Senda | G09G 3/3283 345/214 |
| 2012/0256970 | A1* | 10/2012 | Kim | G09G 3/2003 345/690 |

FOREIGN PATENT DOCUMENTS

| | | |
|---|---|---|
| KR | 1020050104489 | 11/2005 |
| KR | 1020070092131 | 9/2007 |
| KR | 1020080014331 | 2/2008 |

* cited by examiner

DATA DRIVER

CROSS-REFERENCE TO RELATED APPLICATION

This application claims priority under 35 U.S.C. §119 to Korean Patent Application No. 10-2014-0069745, filed on Jun. 9, 2014, in the Korean Intellectual Property Office (KIPO), the disclosure of which is incorporated by reference herein in its entirety.

TECHNICAL FIELD

The present inventive concept relates to a display device, and more particularly to a data driver included in the display device.

DISCUSSION OF THE RELATED ART

A display panel may include a plurality of pixels and a data driver that provides a plurality of data signals to the plurality of pixels. As a resolution of the display panel becomes larger, the number of the pixels included in the display panel has increased, and thus, the complexity of the data driver has increased.

To reduce such complexity of the data driver, a multiplexer and a demultiplexer may be employed in a display device to combine the plurality of data signals and to demultiplex the combined data signals. Thus, the number of circuits in the display panel may be reduced.

SUMMARY

According to an exemplary embodiment of the present inventive concept, a data driver is provided. The data driver includes first through n-th shift register units, first through n-th latch units, and first through n-th output buffer units. The first through n-th shift register unit are configured to shift and store a plurality of image data output from a timing controller. The first shift register unit includes first through m-th shift registers, where n and m are natural numbers equal to or greater than two. The first through m-th shift registers are configured to shift and store first through m-th image data among the plurality of image data output from a timing controller. The first through n-th latch units are connected to the first through n-th shift register units, respectively. The first latch unit includes first through m-th latches. The first through n-th output buffer units are connected to the first through n-th latch units, respectively. The first output buffer unit includes first through m-th output buffers. The first through n-th latch units are configured to sequentially latch the plurality of image data stored in the first through n-th shift register units.

In an exemplary embodiment of the present inventive concept, an operating frequency of the data driver may be n times greater than an operating frequency of a scan driver.

In an exemplary embodiment of the present inventive concept, one horizontal period may be divided into first through n-th periods. A j-th latch unit among the first through n-th latch units may be configured to latch j-th image data stored in a j-th shift register unit among the first through n-th shift register units during a j-th period among the first through n-th periods, where j is a natural number equal to or greater than one and equal to or less than n. A j-th output buffer unit among the first through n-th output buffer units may be configured to generate a plurality of pixel voltages based on the latched j-th image data, respectively, during the j-th period.

In an exemplary embodiment of the present inventive concept, the first image data stored in the first shift register when n is three and j is one may correspond to red image data applied to red pixels configured to output red light. The first image data may be processed during the first period among the first through third periods. The second image data stored in the second shift register when n is three and j is two may correspond to green image data applied to green pixels configured to output green light. The second image data may be processed during the second period among the first through third periods. The third image data stored in the third shift register when n is three and j is three may correspond to blue image data applied to blue pixels configured to output blue light. The third image data may be processed during the third period among the first through third periods.

In an exemplary embodiment of the present inventive concept, the first latch unit among the first through third latch units when n is three and j is one may be configured to latch the red image data stored in the first shift register unit among the first through third shift register units during the first period. The second latch unit among the first through third latch units when n is three and j is two may be configured to latch the green image data stored in a second shift register unit among the first through third shift register units during the second period. The third latch unit among the first through third latch units when n is three and j is three may be configured to latch the blue image data stored in the third shift register unit among the first through third shift register units during the third period.

In an exemplary embodiment of the present inventive concept, the first output buffer unit among the first through third output buffer units when n is three and j is one may be configured to generate first pixel voltages applied to the red pixels based on the red image data latched by the first latch unit during the first period. The second output buffer unit among the first through third output buffer units when n is three and j is two may be configured to generate second pixel voltages applied to the green pixels based on the green image data latched by the second latch unit during the second period. The third output buffer unit among the first through third output buffer units when n is three and j is three may be configured to generate third pixel voltages applied to the blue pixels based on the blue image data latched by the third latch unit during the third period.

In an exemplary embodiment of the present inventive concept, each of the first through m-th output buffers may include a digital-to-analog converter (DAC) and a voltage generator. The DAC may convert an output signal from one of the first through m-th latches into an analog signal. The voltage generator may generate one of the plurality of pixel voltages based on the analog signal.

According to an exemplary embodiment of the present inventive concept, a data driver is provided. The data driver includes a shift register unit, first through m-th latch units, and first through m-th output buffer units. The shift register unit includes first through m-th shift registers. The first shift register is configured to shift and store first to n-th image data output from a timing controller, where n and m are natural numbers equal to or greater than two. The first through m-th latch units are connected to the first through m-th shift registers, respectively. The first latch unit includes first through n-th latches. The first through m-th output buffer units are connected to the first through m-th latch units, respectively. The first output buffer unit includes first through n-th output buffers. The first through n-th latches are configured to sequentially latch of the first through n-th image data stored in the first shift register.

In an exemplary embodiment of the present inventive concept, an operating frequency of the data driver may be n times greater than an operating frequency of a scan driver.

In an exemplary embodiment of the present inventive concept, one horizontal period may be divided into first through n-th periods. A j-th latch among the first through n-th latches included in the first latch unit may be configured to latch j-th image data of the first through n-th image data stored in the first shift register during a j-th period among the first through n-th periods, where j is a natural number equal to or greater than one and equal to or less than n. A j-th output buffer among the first through n-th output buffers included in the first output buffer unit may be configured to generate a pixel voltage based on the j-th image data latched by the j-th latch during the j-th period.

In an exemplary embodiment of the present inventive concept, the first image data among the first through third image data stored in the first shift register when n is three and j is one may correspond to red image data applied to a red pixel configured to output red light. The first image data may be processed during the first period among the first through third periods. The second image data among the first through third image data stored in the first shift register when n is three and j is two may correspond to green image data applied to a green pixel configured to output green light. The second data may be processed during the second period among the first through third periods. The third image data among the first through third image data stored in the first shift register when n is three and j is three may correspond to blue image data applied to a blue pixel configured to output blue light. The third image data may be processed during the third period among the first through third periods.

In an exemplary embodiment of the present inventive concept, the first latch among the first through third latches included in the first latch unit when n is three and j is one may be configured to latch the red image data stored in the first shift register during the first period. The second latch among the first through third latches included in the first latch unit when n is three and j is two may be configured to latch the green image data stored in the first shift register during the second period. The third latch among the first through third latches included in the first latch unit when n is three and j is three may be configured to latch the blue image data stored in the first shift register during the third period.

In an exemplary embodiment of the present inventive concept, the first output buffer among the first through third output buffers included in the first output buffer unit when n is three and j is one may be configured to generate a first pixel voltage applied to the red pixel based on the red image data latched by the first latch during the first period. The second output buffer among the first through third output buffers included in the first output buffer unit when n is three and j is two may be configured to generate a second pixel voltage applied to the green pixel based on the green image data latched by the second latch during the second period. The third output buffer among the first through third output buffers included in the first output buffer unit when n is three and j is three may be configured to generate a third pixel voltage applied to the blue pixel based on the blue image data latched by the third latch during the third period.

In an exemplary embodiment of the present inventive concept, the j-th output buffer may include a digital-to-analog converter (DAC) and a voltage generator. The DAC may convert an output signal from the j-th latch into an analog signal. The voltage generator may generate the pixel voltage based on the analog signal.

According to an exemplary embodiment of the present inventive concept, a data driver is provided. The data driver includes a shift register unit, a latch unit, and first through m-th output buffer units. The shift register unit includes first through m-th shift registers. The first shift register is configured to shift and store first through n-th image data output from a timing controller, where n and m are natural numbers equal to or greater than two. The latch unit includes first through m-th latches. The first through m-th latches are connected to the first through m-th latches, respectively. The first through m-th output buffer units are connected to the first through m-th latch units, respectively. The first output buffer unit includes first through n-th output buffers. The first through n-th output buffers are configured to sequentially generate first through n-th pixel voltages, respectively, based on the first through n-th image data latched by the first latch.

In an exemplary embodiment of the present inventive concept, an operating frequency of the data driver may be n times greater than an operating frequency of a scan driver.

In an exemplary embodiment of the present inventive concept, one horizontal period may be divided into first through n-th periods. A j-th output buffer among the first through n-th output buffers included in the first output buffer unit may be configured to generate a pixel voltage based on one of the first through n-th image data latched by the first latch during a j-th period among the first through n-th periods.

In an exemplary embodiment of the present inventive concept, the first image data among the first through third image data stored in the first shift register when n is three and j is one may correspond to red image data applied to a red pixel configured to output red light. The first image data may be processed during the first period among the first through third periods. The second data among the first through third image data stored in the first shift register when n is three and j is two may correspond to green image data applied to a green pixel configured to output green light. The second image data may be processed during the second period among the first through third periods. The third image data among the first through third of image data stored in the first shift register when n is three and j is three may correspond to blue image data applied to a blue pixel configured to output blue light. The third image data may be processed during the third period among the first through third periods.

In an exemplary embodiment of the present inventive concept, the first output buffer among the first through third output buffers included in the first output buffer unit when n is three and j is one may be configured to generate a first pixel voltage applied to the red pixel based on the red image data latched by the first latch during the first period. The second output buffer among the first through third output buffers included in the first output buffer unit when n is three and j is two may be configured to generate a second pixel voltage applied to the green pixel based on the green image data latched by the first latch during the second period. The third output buffer among the first through third output buffers included in the first output buffer unit when n is three and j is three may be configured to generate a third pixel voltage applied to the blue pixel based on the blue image data latched by the first latch during the third period.

In an exemplary embodiment of the present inventive concept, the j-th output buffer may include a digital-to-analog converter (DAC) and a voltage generator. The DAC may convert an output signal from the first latch into an analog signal. The voltage generator may generate the pixel voltage based on the analog signal.

According to an exemplary embodiment of the present inventive concept, a data driver is provided. The data driver is configured to receive a first plurality of image data through an n-th plurality of image data and to generate a first plurality of pixel voltages through an n-th plurality of pixel voltages, wherein n is a natural number of at least two. The data driver includes a plurality of registers, a plurality of latch units, and a plurality of output buffer units. A first register of the plurality of registers is configured to shift and store image data selected from each of the first plurality of image data through the n-th plurality of image data. A first latch unit of the plurality of latch units is configured to latch the stored image data selected from each of the first plurality of image data through the n-th plurality of image data. A first output buffer unit of the plurality of output buffer units includes first through n-th output buffers. The first through n-th output buffers are configured to sequentially generate the first plurality of pixel voltages through the n-th plurality of pixel voltages, respectively, based on the latched image data selected from each of the first plurality of image data through the n-th plurality of image data. The first plurality of pixel voltages through the n-th plurality of pixel voltages corresponds to different color image data, respectively.

BRIEF DESCRIPTION OF THE DRAWINGS

The present inventive concept and many of the attendant aspects thereof will be more clearly understood by reference to the following detailed description when considered in conjunction with the accompanying drawings in which.

DETAILED DESCRIPTION OF THE EMBODIMENTS

Figure 1:
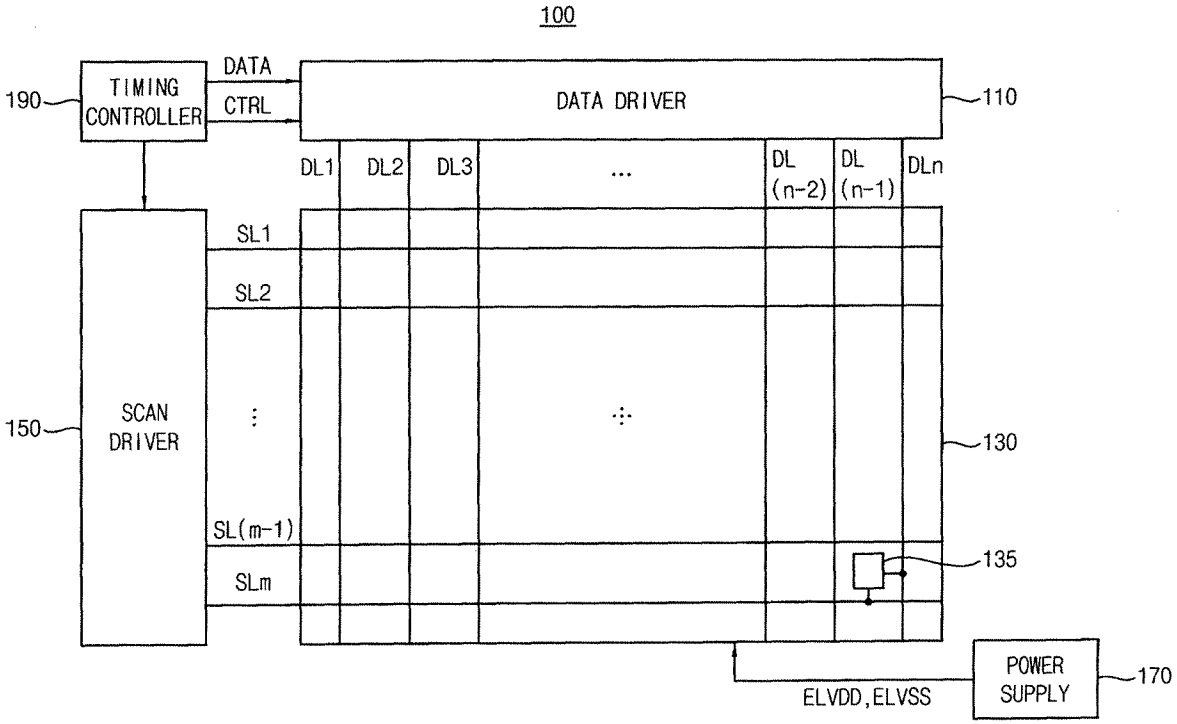
FIG. 1 is a block diagram illustrating a display device according to an exemplary embodiment of the present inventive concept.

Hereinafter, exemplary embodiments of the present inventive concept will be described in more detail with reference to the accompanying drawings. Like or similar reference numerals may refer to like or similar elements throughout the specification and drawings.

FIG. 1 is a block diagram illustrating a display device according to an exemplary embodiment of the present inventive concept.

Referring to FIG. 1, a display device 100 includes a data driver 110, a display panel 130, a scan driver 150, a power supply 170, and a timing controller 190. The display panel 130 may include a plurality of pixels 135.

The data driver 110 may receive a plurality of image data DATA that are output from the timing controller 190 in serial. The plurality of image data DATA may not be appropriate to drive the plurality of pixels 135. The data driver 110 may generate a plurality of data signals that are appropriate to drive the plurality of pixels 135 based on the plurality of image data DATA and may apply the plurality of data signals to the plurality of pixels 135 through a plurality of data lines DL1, DL2, DL3, . . . , DL(n−2), DL(n−1), DLn, where n is a natural number equal to or greater than two.

The plurality of data signals may have grayscale information with respect to an image to be displayed on the display panel 130. The plurality of data signals may be applied to the plurality of pixels 135 based on a plurality of scan signals. In an analog driving method, luminance of the plurality of pixels 135 may be controlled based on voltage levels of the data signals. For example, to display three different grayscales in the analog driving method, the data signals may have three different levels, e.g., about 1V, 2V, and 3V. In a digital driving method, the luminance of the plurality of pixels 135 may be controlled based on the number of enabled sub-frames among a plurality of sub-frames included in each data signal. For example, to display different grayscales in the digital driving method, each data signal may include the plurality of sub-frames, each sub-frame may have one of ON/OFF levels, e.g., about 0V and 5V, and the number of the enabled sub-frames (e.g. sub-frames having the ON level) in each data signal may be controlled to represent the different grayscales. Although the examples of the data signals described above are based on the analog and digital driving methods, the data signals of the present inventive concept are not limited thereto.

As the number of the plurality of pixels 135 included in the display panel 130 increases, the number of circuits included in the data driver 110 may increase. To reduce the number of the circuits included in the data driver 110, the display device 100 may perform a multiplexing operation and a demultiplexing operation. For example, a multiplexed signal may be generated by combining the data signals, the multiplexed signal may be demultiplexed, and then the demultiplexed data signals may be sequentially applied to the plurality of data lines DL1, . . . , DLn.

The display device 100 according to an exemplary embodiment of the present inventive concept may not include an additional demultiplexer for the demultiplexing operation, and the data driver 110 included in the display device 100 may perform the demultiplexing operation. For example, the plurality of pixels 135 may include a red pixel for outputting red light, a green pixel for outputting green light, and a blue pixel for outputting blue light. Thus, red image data may be applied to the red pixel, green image data may be applied to the green pixel, and blue image data may be applied to the blue pixel. The multiplexed signal may be generated by combining the red image data, the green image data and the blue image data. The data driver 110 may demultiplex the multiplexed signal and may sequentially apply the red image data, the green image data, and the blue image data to a data line connected to the red pixel, a data line connected to the green pixel, and a data line connected to the blue pixel, respectively.

As described above, the display panel 130 may include the plurality of pixels 135. The plurality of pixels 135 may be connected to the plurality of data lines DL1, . . . , DLn and a plurality of scan lines SL1, SL2, . . . , SL(m−1), SLm, where m is a natural number equal to or greater than two.

The plurality of pixels 135 may receive the data signals through the plurality of data lines DL1, . . . , DLn and may receive the scan signals through the plurality of scan lines SL1, . . . , SLm.

The plurality of pixels 135 may emit light according to the data signals. In addition, the plurality of pixels 135 may emit light based on power supply voltages ELVDD and ELVSS generated by the power supply 170. As described above, in the analog driving method, the luminance of the plurality of pixels 135 may be controlled based on the voltage levels of the data signals. In addition, the luminance of the plurality of pixels 135 may be varied when a level of the power supply voltage ELVDD and/or a level of the power supply voltage ELVSS are changed. For example, even if the voltage levels of the data signals are maintained at about 1V, currents flowing through the plurality of pixels 135 may be changed when the power supply voltage ELVDD is changed from about 3V to about 3.5V. Thus, the luminance of the plurality of pixels 135 may be varied based on the changed power supply voltage ELVDD. Although the examples of the voltage levels of the data signals and the level of the power supply voltage ELVDD described above are based on the analog driving method, the voltage levels of the data signals and the level of the power supply voltage ELVDD of the present inventive concept are not limited thereto.

The scan driver 150 may generate the scan signals and may apply the scan signals to the plurality of pixels 135 through the plurality of scan lines SL1, . . . , SLm. As described above, the data signals may be applied to the plurality of pixels 135 based on the scan signals. For example, when the scan driver 150 activates a k-th scan signal applied to a k-th scan line, where k is a natural number equal to or greater than one and equal to or less than m, the data driver 110 may apply the data signals to pixels connected to the k-th scan line through the plurality of data lines DL1, . . . , DLn.

The power supply 170 may generate the power supply voltages ELVDD and ELVSS and may provide the power supply voltages ELVDD and ELVSS to the plurality of pixels 135 included in the display panel 130.

The timing controller 190 may control operations of the data driver 110 and the scan driver 150, and may provide the plurality of image data DATA to the data driver 110. In addition, the timing controller 190 may provide a control signal CTRL to the data driver 110. The data driver 110 may perform the demultiplexing operation based on the control signal CTRL.

Although it is illustrated that the multiplexed signal is generated based on the red image data, the green image data, and the blue image data, the present inventive concept is not limited thereto. In addition, the present inventive concept is not limited to the examples of the voltage levels of the data signals and the level of the power supply voltage ELVDD, and the example where the data signals are applied to the pixels described above.

Figure 2:
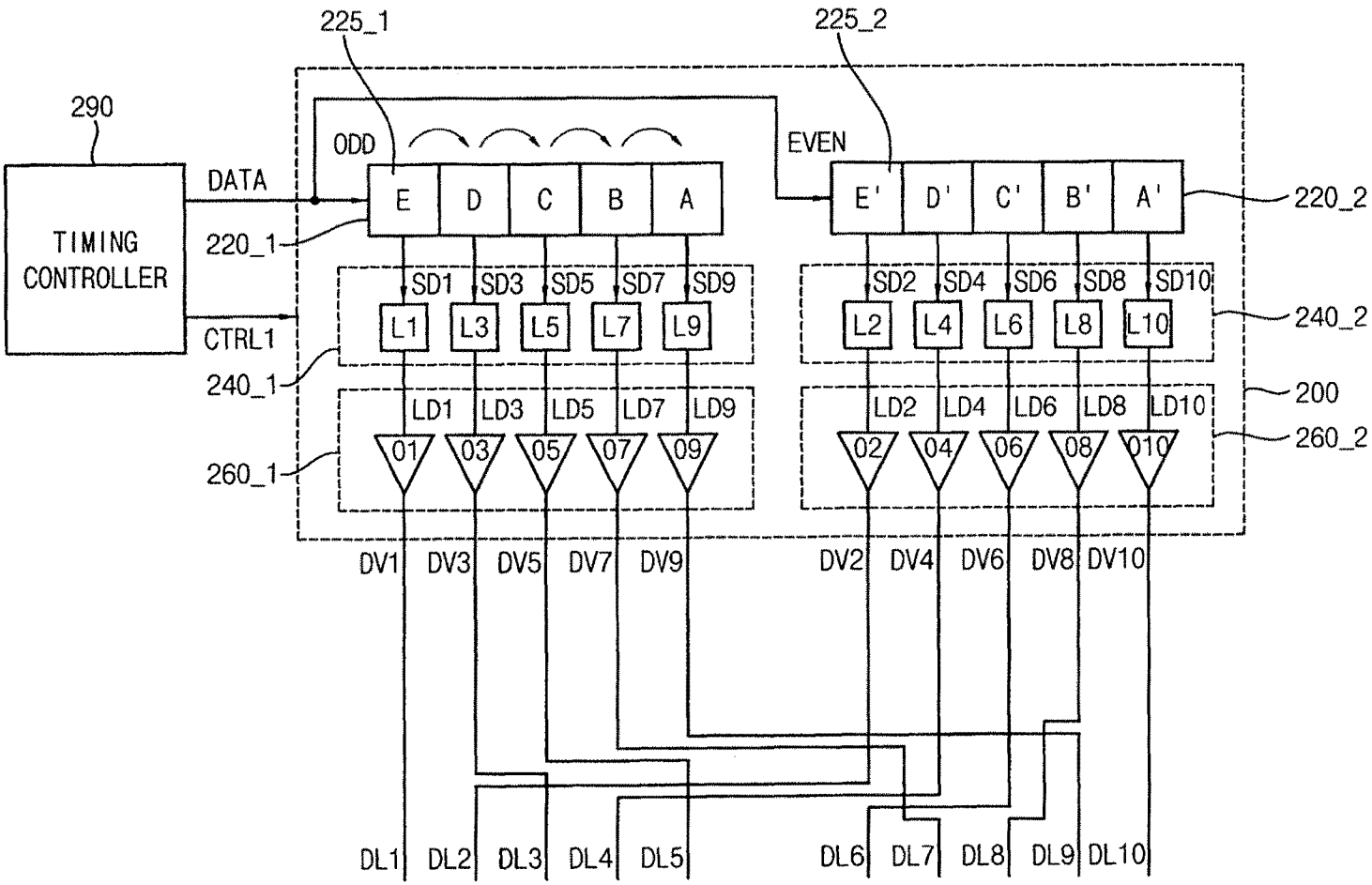
FIG. 2 is a block diagram illustrating a data driver included in the display device of FIG. 1 according to an exemplary embodiment of the present inventive concept.

FIG. 2 is a block diagram illustrating a data driver included in the display device of FIG. 1 according to an exemplary embodiment of the present inventive concept.

Referring to FIG. 2, a data driver 200 includes first and second shift register units 220_1 and 220_2, first and second latch units 240_1 and 240_2, and first and second output buffer units 260_1 and 260_2.

In an exemplary embodiment of the present inventive concept, an operating frequency of the data driver 200 may be n times greater than an operating frequency of the scan driver 150 in FIG. 1, where n is a natural number equal to or greater than two. The data driver 200 may have an operating speed which is n times faster than that of the scan driver 150, and thus the data driver 200 may perform the demultiplexing operation.

In an exemplary embodiment of the present inventive concept, operations of the first and second shift register units 220_1 and 220_2, the first and second latch units 240_1 and 240_2, and the first and second output buffer units 260_1 and 260_2 may be controlled based on a control signal CTRL1 that is output from a timing controller 290.

Each of the first and second shift register units 220_1 and 220_2 includes a plurality of shift registers (e.g., 225_1 or 225_2). The plurality of shift registers (e.g., 225_1 or 225_2) included each of the shift register units 220_1 and 220_2 may shift and store the plurality of image data DATA that are output from the timing controller 290. The plurality of image data DATA may be output from the timing controller 290 in serial. Parallel image data SD1, SD2, SD3, SD4, SD5, SD6, SD7, SD8, SD9, and SD10 may be generated by shifting and storing the plurality of image data DATA. For example, the plurality of shift registers 225_1 included in the first shift register unit 220_1 may shift and store first image data SD1, SD3, SD5, SD7, and SD9. The plurality of shift registers 225_2 included in the second shift register unit 220_2 may shift and store second image data SD2, SD4, SD6, SD8, and SD10.

For convenience of description, FIG. 2 illustrates that the first shift register unit 220_1 stores the first image data SD1, SD3, SD5, SD7, and SD9 for odd-numbered (ODD) data lines DL1, DL3, DL5, DL7, and DL9, the second shift register unit 220_2 stores the second image data SD2, SD4, SD6, SD8, and SD10 for even-numbered (EVEN) data lines DL2, DL4, DL6, DL8, and DL10, and each of the first and second shift register units 220_1 and 220_2 includes five shift registers. However, the number of the shift register units and the number of the shift registers included in each shift register unit are not limited thereto. For example, the data driver according to an exemplary embodiment of the present inventive concept may include first through n-th shift register units, and each of the first through n-th shift register units may include first through m-th shift registers, where n and m are natural numbers each equal to or greater than two.

In an exemplary embodiment of the present inventive concept, substantially the same image data DATA may be input to the first shift register unit 220_1 and the second shift register unit 220_2. For example, the first image data (e.g., SD1, SD3, SD5, SD7, and SD9) provided to the first shift register unit 220_1 may be substantially the same as the second image data (e.g., SD2, SD4, SD6, SD8, and SD10) provided to the second shift register unit 220_2. The shift registers 225_1 included in the first shift register unit 220_1 and the shift registers 225_2 included in the second shift register unit 220_2 may shift and store the same image data DATA. For example, when the image data DATA provided to the first and second shift register units 220_1 and 220_2 correspond to serial data of "ABCDE", each of the shift registers 225_1 and 225_2 may shift and store "ABCDE" in an order of an input. Thus, "A", which is a first input data of the image data DATA, may be stored in a fifth shift register in the first shift register unit 220_1 and a fifth shift register in the second shift register unit 220_2, and "E", which is a fifth input data of the image data DATA, may be stored in a first shift register in the first shift register unit 220_1 and a first shift register in the second shift register unit 220_2.

In an exemplary embodiment of the present inventive concept, as illustrated in FIG. 2, image data input to the first shift register unit 220_1 and second shift register unit 220_2 may be different from each other. For example, the first image data (e.g., SD1, SD3, SD5, SD7, and SD9) provided to the first shift register unit 220_1 may be different from the second image data (e.g., SD2, SD4, SD6, SD8, and SD10) provided to the second shift register unit 220_2. The shift registers 225_1 included in the first shift register unit 220_1 and the shift registers 225_2 included in the second shift register unit 220_2 may shift and store the different image data. For example, when the first image data provided to the first shift register unit 220_1 correspond to serial data of "ABCDE", the shift registers 225_1 included in the first shift register unit 220_1 may shift and store "ABCDE" in an order of an input. In addition, when the second image data provided to the second shift register unit 220_2 correspond to serial data of "A'B'C'D'E'", the shift registers 225_2 included in the second shift register unit 220_2 may shift and store "A'B'C'D'E'" in an order of an input. Thus, "A", which is a first input data of the image data input to the first shift register unit 220_1, may be stored in a fifth shift register in the first shift register unit 220_1, and "A'", which is a first input data of the image data input to the second register unit 220_2, may be stored in a fifth shift register in the second shift register unit 220_2. In addition, "E", which is a fifth input data of the image data input to the first shift register unit 220_1, may be stored in a first shift register in the first shift register unit 220_1, and "E'", which is a fifth input data input to the second register unit 220_2, may be stored in a first shift register in the second shift register unit 220_2.

The first and second latch units 240_1 and 240_2 are connected to the first and second shift register units 220_1 and 220_2, respectively. Each of the first and second latch units 240_1 and 240_2 includes a plurality of latches. For example, the first latch unit 240_1 may include latches L1, L3, L5, L7, and L9, and the second latch unit 240_2 may include latches L2, L4, L6, L8, and L10.

In an exemplary embodiment of the present inventive concept, the first and second latch units 240_1 and 240_2 may sequentially latch the plurality of image data DATA (e.g., the first and second image data SD1~SD10) stored in the first and second shift register units 220_1 and 220_2 based on the control signal CTRL1. For example, the first latch unit 240_1 may latch the first image data SD1, SD3, SD5, SD7, and SD9. The second latch unit 240_2 may latch the second image data SD2, SD4, SD6, SD8, and SD10 after the first image data SD1, SD3, SD5, SD7, and SD9 are latched.

For convenience of description, FIG. 2 illustrates that the first latch unit 240_1 latches the first image data SD1, SD3, SD5, SD7, and SD9 for the odd-numbered (ODD) data lines DL1, DL3, DL5, DL7, and DL9, the second latch unit 240_2 latches the second image data SD2, SD4, SD6, SD8, and SD10 for the even-numbered (EVEN) data lines DL2, DL4, DL6, DL8, and DL10, and each of the first and second latch units 240_1 and 240_2 includes five latches. However, the number of the latch units and the number of the latches included in each latch unit are not limited thereto. For example, the data driver according to an exemplary embodiment of the present inventive concept may include first through n-th latch units, and each of the first through n-th latch units may include first through m-th latches, where n and m are natural numbers each equal to or greater than two.

The first and second output buffer units 260_1 and 260_2 are connected to the first and second latch units 240_1 and 240_2, respectively. Each of the first and second output buffer units 260_1 and 260_2 includes a plurality of output buffers. For example, the first output buffer unit 260_1 may include output buffers O1, O3, O5, O7, and O9, and the second output buffer unit 260_2 may include output buffers O2, O4, O6, O8, and O10.

In an exemplary embodiment of the present inventive concept, each of the output buffers O1~O10 may generate one of a plurality of pixel voltages DV1, DV2, DV3, DV4, DV5, DV6, DV7, DV8, DV9, and DV10 based on one of latched image data LD1, LD2, LD3, LD4, LD5, LD6, LD7, LD8, LD9, and LD10 latched by the latches L1~L10, respectively. For example, the output buffer O1 may generate the pixel voltage DV1 based on the latched image data LD1 latched by the latch L1.

For convenience of description, FIG. 2 illustrates that the first output buffer unit 260_1 generates the first pixel voltages DV1, DV3, DV5, DV7, and DV9 and provides the first pixel voltages DV1, DV3, DV5, DV7, and DV9 to the odd-numbered (ODD) data lines DL1, DL3, DL5, DL7, and DL9, respectively. The second output buffer unit 260_2 generates the second pixel voltages DV2, DV4, DV6, DV8, and DV10 and provides the second pixel voltages DV2, DV4, DV6, DV8, and DV10 to the even-numbered (EVEN) data lines DL2, DL4, DL6, DL8, and DL10, respectively. In addition, each of the first and second output buffer units 260_1 and 260_2 includes five output buffers. However, the number of the output buffer units and the number of the output buffers included in each output buffer unit are not limited thereto. For example, the data driver according to an exemplary embodiment of the present inventive concept may include first through n-th output buffer units, and each of the first through n-th output buffer units may include first through m-th output buffers, where n and m are natural numbers each equal to or greater than two.

In an exemplary embodiment of the present inventive concept, one horizontal period may be divided into first through n-th periods. For example, referring to FIG. 2, during j-th period among the first through n-th periods, a j-th latch unit among the first through n-th latch units may latch image data (e.g., the first image data of SD1, SD3, SD5, SD7, and SD9 or the second image data of SD2, SD4, SD6, SD8, and SD10) stored in a j-th shift register unit among the first through n-th shift register units, where j is a natural number equal to or greater than one and equal to or less than n. A j-th output buffer unit among the first through n-th output buffer units may generate pixel voltages (e.g., DV1, DV3, DV5, DV7, and DV9 or DV2, DV4, DV6, DV8, and DV10) based on the image data latched by the j-th latch unit during the j-th period.

For example, when n is 2, the first latch unit 240_1 may latch the first image data SD1, SD3, SD5, SD7, and SD9 stored in the first shift register unit 220_1 during a first period, and the first output buffer unit 260_1 may generate the first pixel voltages DV1, DV3, DV5, DV7, and DV9 based on the latched first image data LD1, LD3, LD5, LD7, and LD9 latched by the first latch unit 240_1 and may provide the first pixel voltages DV1, DV3, DV5, DV7, and DV9 to the odd-numbered (ODD) data lines DL1, DL3, DL5, DL7, and DL9, respectively, during the first period. In addition, when n is 2, the second latch unit 240_2 may latch the second image data SD2, SD4, SD6, SD8, and SD10 stored in the second shift register unit 220_2 during a second period, and the second output buffer unit 260_2 may generate the second pixel voltages DV2, DV4, DV6, DV8, and DV10 based on the latched second image data LD2, LD4, LD6, LD8, and LD10 latched by the second latch unit 240_2 and provide the second pixel voltages DV2, DV4, DV6, DV8, and DV10 to the even-numbered (EVEN) data lines DL2, DL4, DL6, DL8, and DL10, respectively, during the second period. Although the example where the data driver includes two shift register units, two latch units, and two output buffer units (e.g., the example where n is two) is described above, the number of the shift register units, the number of the latch units, and the number of the output buffer units in the data driver (e.g., n) are not limited thereto.

In an exemplary embodiment of the present inventive concept, the data driver may includes three shift register units, three latch units, and three output buffer units, which corresponds to a case, for example, when n is three. In this embodiment, the first image data (e.g., SD1, SD3, SD5, SD7, and SD9) may correspond to red image data that are applied to red pixels for outputting red light. The first image data may be processed during a first period among the first through third periods. The second image data (e.g., SD2, SD4, SD6, SD8, and SD10) may correspond to green image data that are applied to green pixels for outputting green light. The second image data may be processed during a second period among the first through third periods. Third image data may correspond to blue image data that are applied to blue pixels for outputting blue light. The third image data may be processed during a third period among the first through third periods.

The first latch unit (e.g., 240_1) among the first through third latch units may latch the red image data (e.g., SD1, SD3, SD5, SD7, and SD9) stored in the first shift register unit (e.g., 220_1) among the first through third shift register units during the first period. The second latch unit (e.g., 240_2) among the first through third latch units may latch the green image data (e.g., SD2, SD4, SD6, SD8, and SD10) stored in a second shift register unit (e.g., 220_2) among the first through third shift register units during the second period. The third latch unit among the first through third latch units may latch the blue image data stored in the third shift register unit among the first through third shift register units during the third period.

In addition, the first output buffer unit (e.g., 260_1) among the first through third output buffer units may generate first pixel voltages (e.g., DV1, DV3, DV5, DV7, and DV9) applied to the red pixels based on the red image data (e.g., LD1, LD3, LD5, LD7, and LD9) latched by the first latch unit (e.g., 240_1) during the first period. A second output buffer unit (e.g., 260_2) among the first through third output buffer units may generate second pixel voltages (e.g., DV2, DV4, DV6, DV8, and DV10) applied to the green pixels based on the green image data (e.g., LD2, LD4, LD6, LD8, and LD10) latched by the second latch unit (e.g., 240_2) during the second period. The third output buffer unit among the first through third output buffer units may generate third pixel voltages applied to the blue pixels based on the blue image data latched by the third latch unit during the third period.

The data driver 200 according to an exemplary embodiment of the present inventive concept may generate the pixel voltages DV1~DV10 by performing the demultiplexing operation. Accordingly, a display device including the data driver 200 may perform the demultiplexing operation without an additional demultiplexer, and thus the display device including the data driver 200 may be implemented with a relatively small size, a relatively low manufacturing cost, and a relatively narrow bezel area.

Figure 3:
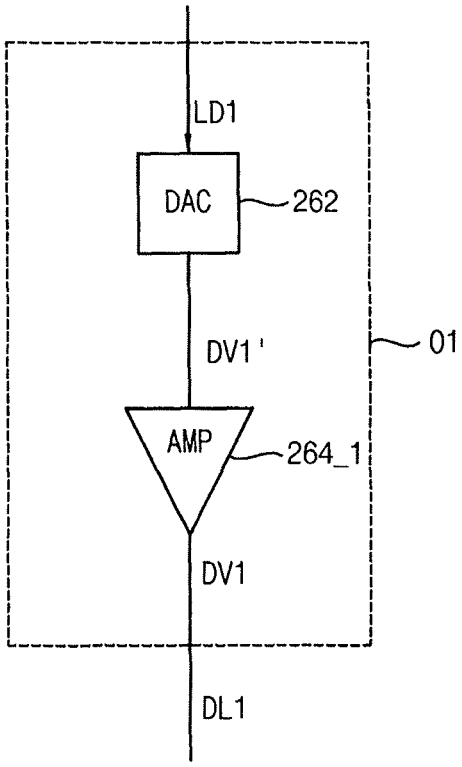
FIG. 3 is a block diagram illustrating an output buffer included in the data driver of FIG. 2 according to an exemplary embodiment of the present inventive concept.

FIG. 3 is a block diagram illustrating an output buffer included in the data driver of FIG. 2 according to an exemplary embodiment of the present inventive concept.

Referring to FIG. 3, an output buffer O1 may include a digital-to-analog converter (DAC) 262 and a voltage generator 264_1.

The DAC 262 may be connected to the latch L1 in FIG. 2 and may convert an output signal (e.g., the latched image data LD1) from the latch L1 in FIG. 2 into an analog signal DV1'. The output signal from the latch L1 may be a digital signal. Since the digital signal may not be appropriate to drive a pixel connected to the data line DL1, the digital signal may be converted into the analog signal DV1' by the DAC 262.

The voltage generator 264_1 may generate the pixel voltage DV1 by amplifying the analog signal DV1'. The pixel voltage DV1 may be applied to the pixel through the data line DL1. In an exemplary embodiment of the present inventive concept, the analog signal DV1' may be directly applied to the pixel through the data line DL1. The configuration and operation of each output buffer of a data driver according to an exemplary embodiment of the present inventive concept may be substantially the same as the output buffer O1 shown in FIG. 3.

Figure 4:
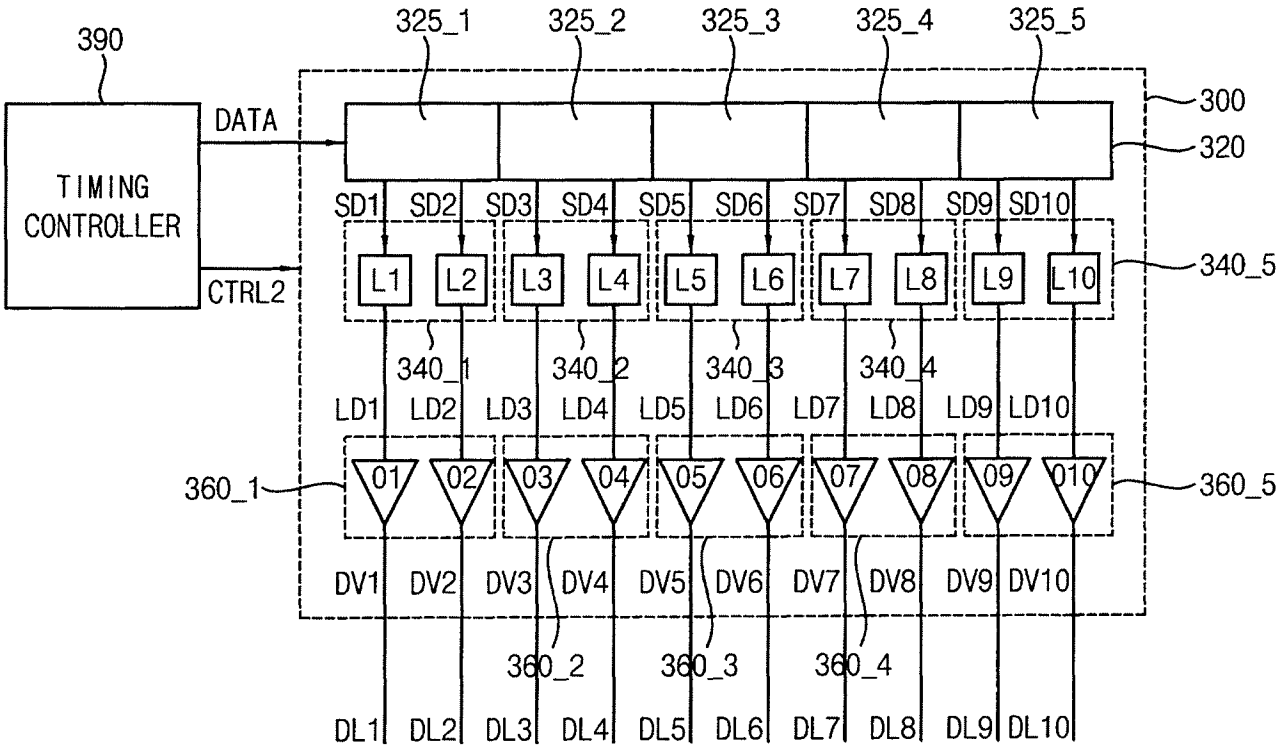
FIG. 4 is a block diagram illustrating a data driver included in the display device of FIG. 1 according to an exemplary embodiment of the present inventive concept.

FIG. 4 is a block diagram illustrating a data driver included in the display device of FIG. 1 according to an exemplary embodiment of the present inventive concept.

Referring to FIG. 4, a data driver 300 includes a shift register unit 320, first through fifth latch units 340_1, 340_2, 340_3, 340_4, and 340_5, and first through fifth output buffer units 360_1, 360_2, 360_3, 360_4, and 360_5.

In an exemplary embodiment of the present inventive concept, an operating frequency of the data driver 300 may be n times greater than an operating frequency of the scan driver 150 in FIG. 1, where n is a natural number equal to or greater than two. The data driver 300 may have an operating speed which is n times faster than that of the scan driver 150, and thus the data driver 300 may perform the demultiplexing operation.

In an exemplary embodiment of the present inventive concept, operations of the shift register unit 320, the first through fifth latch units 340_1, 340_2, 340_3, 340_4, and 340_5, and the first through fifth output buffer units 360_1, 360_2, 360_3, 360_4, and 360_5 may be controlled based on a control signal CTRL2 that is output from a timing controller 390.

The shift register unit 320 includes a plurality of shift registers 325_1 through 325_5. Each of the plurality of shift registers 325_1 through 325_5 may shift and store a portion of the plurality of image data DATA that are output from the timing controller 390. The plurality of image data DATA may be output from the timing controller 390 in serial. Parallel image data SD1, SD2, SD3, SD4, SD5, SD6, SD7, SD8, SD9, and SD10 may be generated by shifting and storing the plurality of image data DATA. For example, a first shift register 325_1 of the plurality of shift registers 325_1 through 325_5 may shift and store first image data SD1 and SD2, a second shift register 325_2 of the plurality of shift registers 325_1 through 325_5 may shift and store second image data SD3 and SD4, a third shift register 325_3 of the plurality of shift registers 325_1 through 325_5 may shift and store third image data SD5 and SD6, a fourth shift register 325_4 of the plurality of shift registers 325_1 through 325_5 may shift and store fourth image data SD7 and SD8, and a fifth shift register 325_5 of the plurality of shift registers 325_1 through 325_5 may shift and store fifth image data SD9 and SD10.

For convenience of description, FIG. 4 illustrates that the shift register unit 320 includes five shift registers. However, the number of the shift registers included in the shift register unit 320 is not limited thereto. For example, the shift register unit 320 may include first through m-th shift registers, where m is a natural number equal to or greater than two.

The first through fifth latch units 3401, 340_2, 340_3, 3404, and 340_5 are connected to the first through fifth shift registers 325_1 through 325_5, respectively. Each of the first through fifth latch units 340_1, 340_2, 340_3, 340_4, and 340_5 includes a plurality of latches. For example, the first latch unit 340_1 may include latches L1 and L2, a second latch unit 340_2 may include latches L3 and L4, a third latch unit 340_3 may include latches L5 and L6, a fourth latch unit 340_4 may include latches L7 and L8, and the fifth latch unit 340_5 may include latches L9 and L10.

In an exemplary embodiment of the present inventive concept, the plurality of latches included in each of the first through fifth latch units 340_1, 340_2, 340_3, 340_4, and 340_5 may sequentially latch the plurality of image data DATA stored in a corresponding one of the first through fifth shift registers 325_1 through 325_5 based on the control signal CTRL2. For example, the latches L1 and L2 included in the first latch unit 340_1 may sequentially latch the first image data SD1 and SD2 stored in the first shift register 325_1. The latch L1 may latch the first data SD1, and the latch L2 may latch the second data SD2 after the first data SD1 is latched. In addition, the latches L3 and L4 included in the second latch unit 340_2 may sequentially latch the second image data SD3 and SD4 stored in the second shift register 325_2, the latches L5 and L6 included in the third latch unit 340_3 may sequentially latch the third image data SD5 and SD6 stored in the third shift register 325_3, the latches L7 and L8 included in the fourth latch unit 340_4 may sequentially latch the fourth image data SD7 and SD8 stored in the fourth shift register 325_4, and the latches L9 and L10 included in the fifth latch unit 340_5 may sequentially latch the fifth image data SD9 and SD10 stored in the fifth shift register 325_5.

For convenience of description, FIG. 4 illustrates that the data driver 300 includes five latch units, and each of the first through fifth latch units 340_1, 340_2, 340_3, 340_4, and 340_5 includes two latches. However, the number of the latch units and the number of the latches included in each latch unit are not limited thereto. For example, the data driver according to an exemplary embodiment of the present inventive concept may include first through m-th latch units, and each of the first through m-th latch units may include first through n-th latches.

In addition, the first through fifth output buffer units 360_1, 360_2, 360_3, 360_4, and 360_5 are connected to the first through fifth latch units 340_1, 340_2, 340_3, 340_4, and 340_5, respectively. Each of the first through fifth output buffer units 360_1, 360_2, 360_3, 360_4, and 360_5 includes a plurality of output buffers. For example, the first output buffer unit 360_1 may include output buffers O1 and O2, the second output buffer unit 360_2 may include output buffers O3 and O4, the third output buffer unit 360_3 may include output buffers O5 and O6, the fourth output buffer unit 360_4 may include output buffers O7 and O8, and the fifth output buffer unit 360_5 may include output buffers O9 and O10.

In an exemplary embodiment of the present inventive concept, each of the output buffers O1~O10 may generate one of a plurality of pixel voltages DV1, DV2, DV3, DV4, DV5, DV6, DV7, DV8, DV9, and DV10 based on one of latched image data LD1, LD2, LD3, LD4, LD5, LD6, LD7, LD8, LD9, and LD10 latched by the latches L~L10, respectively. For example, the output buffer O1 may generate the pixel voltage DV1 based on the latched image data LD1 latched by the latch L1.

For convenience of description, FIG. 4 illustrates that the data driver 300 includes five output buffer units, and each of the first through fifth output buffer units 360_1, 360_2, 360_3, 360_4, and 360_5 includes two output buffers. However, the number of the output buffer units and the number of the output buffers included in each output buffer unit are not limited thereto. For example, the data driver according to an exemplary embodiment of the present inventive concept may include first through m-th output buffer units, and each of the first through m-th output buffer units may include first through n-th output buffers.

In an exemplary embodiment of the present inventive concept, one horizontal period may be divided into first through n-th periods. For example, referring to FIG. 4, during a j-th period among the first through n-th periods, a j-th latch among the plurality of latches included in each of the latch units 340_1, 340_2, 340_3, 340_4, and 340_5 may latch j-th image data among the first through n-th image data in each of the shift registers 325_1 through 325_5, where j is a natural number equal to or greater than one and equal to or less than n. A j-th output buffer among the first through n-th output buffers included in each of the output buffer units 360_1, 360_2, 360_3, 360_4, and 360_5 may generate one of the plurality of pixel voltages DV1~DV10 based on the j-th image data (e.g., LD1) latched by the j-th latch during the j-th period.

For example, the latch L1 in the first latch unit 340_1 may latch the first data SD1 stored in the first shift register 325_1 during the first period, and the output buffer O1 in the first output buffer unit 360_1 may generate the pixel voltage DV1 based on the latched first data LD1 latched by the latch L1 during the first period. In addition, the latches L3, L5, L7, and L9 may latch the data SD3, SD5, SD7, and SD9 during the first period, respectively, and the output buffers O3, O5, O7, and O9 may generate the pixel voltages DV3, DV5, DV7, and DV9 based on the latched data LD3, LD5, LD7, and LD9, respectively, during the first period. The pixel voltages DV1, DV3, DV5, DV7, and DV9 may be provided to odd-numbered data lines DL1, DL3, DL5, DL7, and DL9, respectively, during the first period.

In addition, the latch L2 in the first latch unit 340_1 may latch the second data SD2 stored in the first shift register 325_1 during the second period, and the output buffer O2 in the first output buffer unit 360_1 may generate the pixel voltage DV2 based on the latched second data LD2 latched by the latch L2 during the second period. The latches L4, L6, L8, and L0 may latch the data SD4, SD6, SD8, and SD10, respectively, during the second period, and the output buffers O4, O6, O8, and O10 may generate the pixel voltages DV4, DV6, DV8, and DV10 based on the latched data LD4, LD6, LD8, and LD10, respectively, during the second period. The pixel voltages DV2, DV4, DV6, DV8, and DV10 may be provided to even-numbered data lines DL2, DL4, DL6, DL8, and DL10, respectively, during the second period.

Although the example where each latch unit includes two latches and each output buffer unit includes two output buffer units (e.g., the example where n is two) is described above, the number of the latches in each latch unit and the number of the output buffers in each output buffer unit in the data driver (e.g., n) are not limited thereto.

In an exemplary embodiment of the present inventive concept, each latch unit may include three latches, and each output buffer unit may include three output buffer units, which corresponds to, for example, a case when n is three. In this embodiment, first data may correspond to red image data that is applied to a red pixel for outputting red light. For example, the first data may correspond to pixel voltages (e.g., DV1) output from first output buffers (e.g., O1). The first data may be processed during a first period among the first through third periods. Second data may correspond to green image data that is applied to a green pixel for outputting green light. For example, the second data may correspond to pixel voltages (e.g., DV1) output from first output buffers (e.g., O1). The second data may be processed during a second period among the first through third periods. Third image data may correspond to blue image data that is applied to a blue pixel for outputting blue light. The third data may be processed during a third period among the first through third periods.

The first latch (e.g., L1) among the first through third latches included in each (e.g., 340_1) of the latch units may latch the red image data (e.g., SD1) stored in each of the shift registers (e.g., 325_1 through 325_5) during the first period. The second latch (e.g., L2) among the first through third latches included in each (e.g., 340_1) of the latch units may latch the green image data (e.g., SD2) stored in each of the shift during the second period. The third latch among the first through third latches included in each of the latch units may latch the blue image data stored in each of the shift registers during the third period.

The first output buffer (e.g., O1) among the first through third output buffers included in each (e.g., 360_1) of the output buffer units (e.g., 360_1 through 360_5) may generate a first pixel voltage (e.g., DV1) applied to the red pixel based on the red image data (e.g., LD1) latched by the first latch (e.g., L1) during the first period. The second output buffer (e.g., O2) among the first through third output buffers included in each (e.g., 360_1) of the output buffer units may generate a second pixel voltage (e.g., DV2) applied to the green pixel based on the green image data (e.g., LD2) latched by the second latch (e.g., L2) during the second period. The third output buffer among the first through third output buffers included in each of the output buffer units may generate a third pixel voltage applied to the blue pixel based on the blue image data latched by the third latch during the third period.

Although not described above, the other latches included in the other latch units may sequentially perform such latching operations during the first, second, and third periods, and the other output buffers included in the other output buffer units may sequentially perform such generating operations during the first, second, and third periods.

As described above with reference to FIG. 3, each output buffer may include a DAC and a voltage generator. The DAC 262 may be connected to one of the latches (e.g., L1) and may convert an output signal from one of the latches into an analog signal. The voltage generator (e.g., 264_1) may generate one of the pixel voltages by amplifying the analog signal.

The data driver 300 according to an exemplary embodiment of the present inventive concept may generate the pixel voltages DV1~DV10 by performing the demultiplexing operation. Accordingly, a display device including the data driver 300 may perform the demultiplexing operation without an additional demultiplexer, and thus the display device including the data driver 300 may be implemented with a relatively small size, a relatively low manufacturing cost, and a relatively narrow bezel area.

Figure 5:
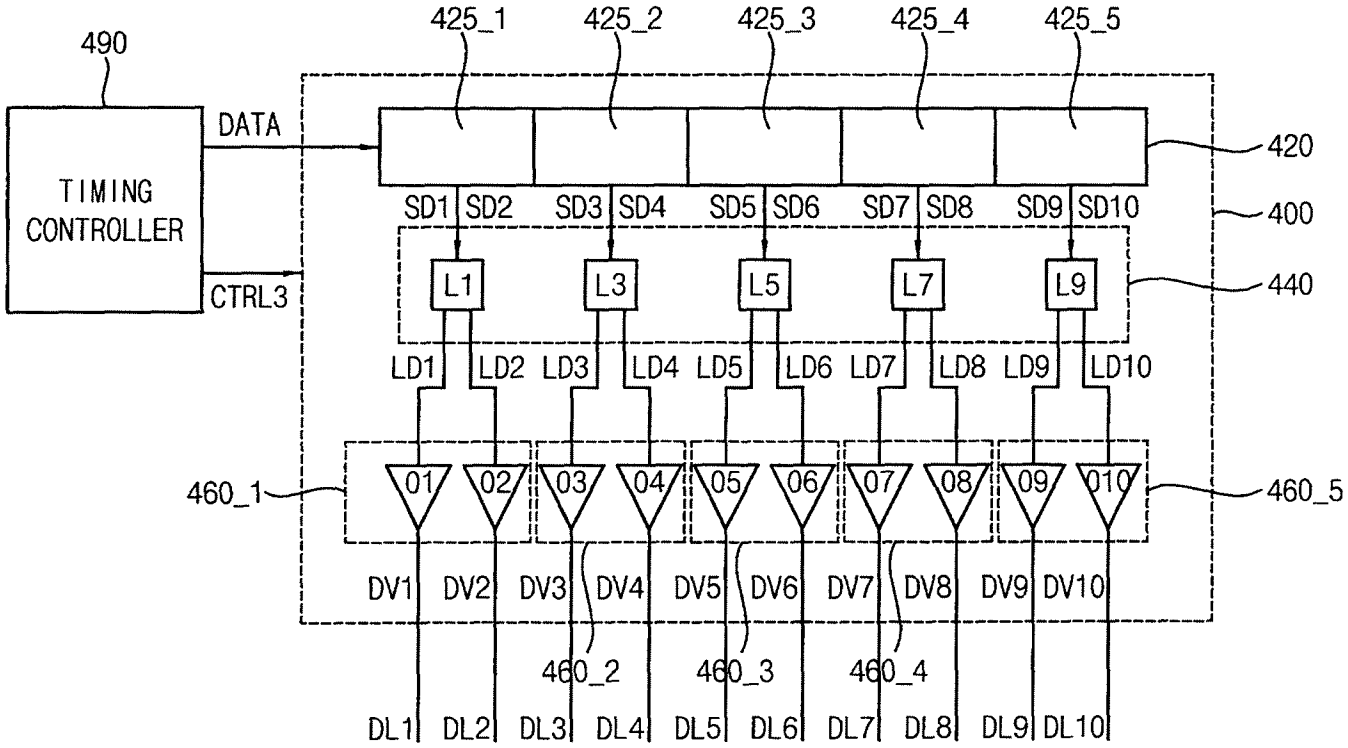
FIG. 5 is a block diagram illustrating a data driver included in the display device of FIG. 1 according to an exemplary embodiment of the present inventive concept.

FIG. 5 is a block diagram illustrating a data driver included in the display device of FIG. 1 according to an exemplary embodiment of the present inventive concept.

Referring to FIG. 5, a data driver 400 includes a shift register unit 420, a latch unit 440, and first through fifth output buffer units 460_1, 460_2, 460_3, 460_4, and 460_5.

In an exemplary embodiment of the present inventive concept, an operating frequency of the data driver 400 may be n times greater than an operating frequency of the scan driver 150 in FIG. 1, where n is a natural number equal to or greater than two. The data driver 400 may have an operating speed which is n times faster than that of the scan driver 150, and thus the data driver 400 may perform the demultiplexing operation.

In an exemplary embodiment of the present inventive concept, operations of the shift register unit 420, the latch unit 440, and the first through fifth output buffer units 460_1, 460_2, 460_3, 460_4, and 460_5 may be controlled based on a control signal CTRL3 that is output from a timing controller 490.

The shift register unit 420 includes a plurality of shift registers 425_1 through 425_5. Each of the plurality of shift registers 425_1 through 425_5 may shift and store the plurality of image data DATA that are output from the timing controller 490. The plurality of image data DATA may be output from the timing controller 490 in serial. Parallel image data SD1, SD2, SD3, SD4, SD5, SD6, SD7, SD8, SD9, and SD10 may be generated by shifting and storing the plurality of image data DATA. For example, a first shift register 425_1 of the plurality of shift registers 425_1 through 425_5 may shift and store first image data SD1 and SD2, a second shift register 425_2 of the plurality of shift registers 425_1 through 425_5 may shift and store second image data SD3 and SD4, a third shift register 425_3 of the plurality of shift registers 425_1 through 425_5 may shift and store third image data SD5 and SD6, a fourth shift register 425_4 of the plurality of shift registers 425_1 through 425_5 may shift and store fourth image data SD7 and SD8, and a fifth shift register 425_5 of the plurality of shift registers 425_1 through 425_5 may shift and store fifth image data SD9 and SD10.

For convenience of description, FIG. 5 illustrates that the shift register unit 420 includes five shift registers. However, the number of the shift registers included in the shift register unit 420 is not limited thereto. For example, the shift register unit 420 may include first through m-th shift registers, where m is a natural number equal to or greater than two.

The latch unit 440 includes a plurality of latches L1, L3, L5, L7, and L9. The plurality of latches L1, L3, L5, L7, and L9 are connected to the first through fifth shift registers 425_1 through 425_5, respectively. Each of the plurality of latches L1, L3, L5, L7, and L9 may latch a portion of the plurality of image data stored in one of the plurality of shift registers 425_1 through 425_5. For example, the latch L1 may latch the first image data SD1 and SD2, the latch L3 may latch the second image data SD3 and SD4, the latch L5 may latch the third image data SD5 and SD6, the latch L7 may latch the fourth image data SD7 and SD8, and the latch L9 may latch the fifth image data SD9 and SD10.

For convenience of description, FIG. 5 illustrates that the latch unit 440 includes five latches. However, the number of the latches included in the latch unit 440 is not limited thereto. For example, the latch unit 440 may include first through m-th shift registers.

The first through fifth output buffer units 460_1, 460_2, 460_3, 460_4, and 460_5 are connected to the plurality of latches L1, L3, L5, L7, and L9, respectively. Each of the first through fifth output buffer units 460_1, 460_2, 460_3, 460_4, and 460_5 includes a plurality of output buffers (e.g., O1 through O10). For example, the first output buffer unit 460_1 may include output buffers O1 and O2, the second output buffer unit 460_2 may include output buffers O3 and O4, the third output buffer unit 460_3 may include output buffers O5 and O6, the fourth output buffer unit 460_4 may include output buffers O7 and O8, and the fifth output buffer unit 460_5 may include output buffers O9 and O10.

In an exemplary embodiment of the present inventive concept, the plurality of output buffers included in each of the first through fifth output buffer units 460_1, 460_2, 460_3, 460_4, and 460_5 may sequentially generate a plurality of pixel voltages, respectively, based on the plurality of image data latched by one of the plurality of latches L1, L3, L5, L7, and L9 based on the control signal CTRL3. For example, the output buffers O1 and O2 included in the first output buffer unit 460_1 may sequentially generate pixel voltages DV1 and DV2, respectively, based on latched first image data LD1 and LD2. The output buffer O1 may generate the pixel voltage DV1, and the output buffer O2 may generate the pixel voltage DV2 after the pixel voltage DV1 is generated. The output buffers O3 and O4 included in the second output buffer unit 460_2 may sequentially generate pixel voltages DV3 and DV4, respectively, based on latched second image data LD3 and LD4, the output buffers O5 and O6 included in the third output buffer unit 460_3 may sequentially generate pixel voltages DV5 and DV6, respectively, based on latched third image data LD5 and LD6, the output buffers O7 and O8 included in the fourth output buffer unit 460_4 may sequentially generate pixel voltages DV7 and DV8, respectively, based on latched fourth image data LD7 and LD8, and the output buffers O9 and O10 included in the fifth output buffer unit 460_5 may sequentially generate pixel voltages DV9 and DV10, respectively, based on latched fifth image data LD9 and LD10.

For convenience of description, FIG. 5 illustrates that the data driver 400 includes five output buffer units, and each of the first through fifth output buffer units 460_1, 460_2, 460_3, 460_4, and 460_5 includes two output buffers. However, the number of the output buffer units and the number of the output buffers included in each output buffer unit are not limited thereto. For example, the data driver according to an exemplary embodiment of the present inventive concept may include first through m-th output buffer units, and each of the first through m-th output buffer units may include first through n-th output buffers.

In an exemplary embodiment of the present inventive concept, one horizontal period may be divided into first through n-th periods. For example, referring to FIG. 5, during a j-th period among the first through n-th periods, a j-th output buffer among the first through n-th output buffers included in each of the output buffer units 460_1, 460_2, 460_3, 460_4, and 460_5 may generate one of the plurality of pixel voltages DV1~DV10 based on a corresponding one of the plurality of image data LD1~LD10 latched by the latches L1, L3, L5, L7, and L9, respectively, where j is a natural number equal to or greater than one and equal to or less than n.

For example, the output buffer O1 in the first output buffer unit 460_1 may generate the pixel voltage DV1 based on latched first data LD1 latched by the latch L1 during a first period. The output buffers O3, O5, O7, and O9 may generate the pixel voltages DV3, DV5, DV7, and DV9, respectively, based on latched data LD3, LD5, LD7, and LD9 latched by the latches L3, L5, L7, and L9, respectively, during the first period. The pixel voltages DV1, DV3, DV5, DV7, and DV9 may be provided to odd-numbered data lines DL1, DL3, DL5, DL7, and DL9, respectively, during the first period.

In addition, the output buffer O2 in the first output buffer unit 460_1 may generate the pixel voltage DV2 based on latched second data LD2 latched by the latch L1 during the second period. The output buffers O4, O6, O8, and O10 may generate the pixel voltages DV4, DV6, DV8, and DV10, respectively, based on latched data LD4, LD6, LD8, and LD10 latched by the latches L3, L5, L7, and L9, respectively, during the second period. The pixel voltages DV2, DV4, DV6, DV8, and DV10 may be provided to even-numbered data lines DL2, DL4, DL6, DL8, and DL10, respectively, during the second period.

Although the example where each output buffer unit includes two output buffer units (e.g., the example where n is two) is described above, the number of the output buffers in each output buffer unit in the data driver (e.g., n) is not limited thereto.

In an exemplary embodiment of the present inventive concept, each output buffer unit may include three output buffer units, which corresponds to, for example, a case when n is three. In this embodiment, first data may correspond to red image data that is applied to a red pixel for outputting red light. For example, the first data may correspond to pixel voltages (e.g., DV1) output from first output buffers (e.g., O1). The first data may be processed during the first period among the first through third periods. Second data may correspond to green image data that is applied to a green pixel for outputting green light. For example, the second data may correspond to pixel voltages (e.g., DV2) output from first output buffers (e.g., O1). The second data may be processed during a second period among the first through third periods. Third data may correspond to blue image data that is applied to a blue pixel for outputting blue light. The third data may be processed during a third period among the first through third periods.

The first output buffer (e.g., O1) among the first through third output buffers included in each of the output buffer units 460_1 through 460_5 may generate a first pixel voltage (e.g., DV1) applied to the red pixel based on the red image data (e.g., LD1) latched by the first latch (e.g., L1) during the first period. The second output buffer (e.g., O2) among the first through third output buffers included in each of the output buffer units 460_1 through 460_5 may generate a second pixel voltage (e.g., DV2) applied to the green pixel based on the green image data (e.g., LD2) latched by the second latch (e.g., L2) during the second period. The third output buffer among the first through third output buffers included in one of the output buffer units 460_1 through 460_5 may generate a third pixel voltage applied to the blue pixel based on the blue image data latched by the third latch during the third period.

Although not described above, the other output buffers included in the other output buffer units may sequentially perform such generating operations during the first, second, and third periods.

As described above with reference to FIG. 3, each output buffer may include a digital to analog converter (DAC) and a voltage generator. The DAC may be connected to one of the latches and may convert an output signal from one of the latches into an analog signal. The voltage generator may generate one of the pixel voltages by amplifying the analog signal.

The data driver 400 according to an exemplary embodiment of the present inventive concept may generate the pixel voltages DV1~DV10 by directly performing the demultiplexing operation. Accordingly, a display device including the data driver 400 may effectively perform the demultiplexing operation without an additional demultiplexer, and thus the display device including the data driver 400 may have a relatively small size, a relatively low manufacturing cost, and a relatively narrow bezel area.

The present inventive concept may be applied to an electronic device having a display device. For example, the present inventive concept may be applied to a television, a computer monitor, a laptop, a digital camera, a cellular phone, a smart phone, a smart pad, a personal digital assistant (PDA), a portable multimedia player (PMP), a MP3 player, a navigation system, a game console, a video phone, etc.

The foregoing is illustrative of exemplary embodiments of the present inventive concept and is not to be construed as being limited thereto. Although a few exemplary embodiments have been described, it will be understood by those skilled in the art that various modifications in form and details may be made thereto without departing from the spirit and scope of the present inventive concept as defined by the claims.

What is claimed is:

1. A data driver comprising:

first through n-th shift register units configured to shift and store a plurality of image data output from a timing controller, the first shift register unit including first through m-th shift registers, wherein the first through m-th shift registers are configured to shift and store first through m-th image data among the plurality of image data output from the timing controller, where n and m are natural numbers equal to or greater than two;

first through n-th latch units connected to the first through n-th shift register units, respectively, the first latch unit including first through m-th latches; and first through n-th output buffer units connected to the first through n-th latch units, respectively, the first output buffer unit including first through m-th output buffers, wherein the first through n-th latch units are configured to sequentially latch the plurality of image data stored in the first through n-th shift register units, wherein one horizontal period is divided into first through n-th periods, wherein a j-th latch unit among the first through n-th latch units is configured to latch j-th image data stored in a j-th shift register unit among the first through n-th shift register units during a j-th period among the first through n-th periods, where j is a natural number equal to or greater than one and equal to or less than n, and wherein a j-th output buffer unit among the first through n-th output buffer units is configured to generate a plurality of pixel voltages based on the latched j-th image data, respectively, during the j-th period, wherein the first image data stored in the first shift register when n is three and j is one correspond to red image data applied to red pixels configured to output red light, the first image data being processed during the first period among the first through third periods, wherein the second image data stored in the second shift register when n is three and j is two correspond to green image data applied to green pixels configured to output green light, the second image data being processed during the second period among the first through third periods, and wherein the third image data stored in the third shift register when n is three and j is three correspond to blue image data applied to blue pixels configured to output blue light, the third image data being processed during the third period among the first through third periods.

2. The data driver of claim 1, wherein an operating frequency of the data driver is n times greater than an operating frequency of a scan driver.

3. The data driver of claim 1, wherein the first latch unit among the first through third latch units when n is three and j is one is configured to latch the red image data stored in the first shift register unit among the first through third shift register units during the first period, wherein the second latch unit among the first through third latch units when n is three and j is two is configured to latch the green image data stored in a second shift register unit among the first through third shift register units during the second period, and wherein the third latch unit among the first through third latch units when n is three and j is three is configured to latch the blue image data stored in the third shift register unit among the first through third shift register units during the third period.

4. The data driver of claim 3, wherein the first output buffer unit among the first through third output buffer units when n is three and j is one is configured to generate first pixel voltages applied to the red pixels based on the red image data latched by the first latch unit during the first period, wherein the second output buffer unit among the first through third output buffer units when n is three and j is two is configured to generate second pixel voltages applied to the green pixels based on the green image data latched by the second latch unit during the second period, and wherein the third output buffer unit among the first through third output buffer units when n is three and j is three is configured to generate third pixel voltages applied to the blue pixels based on the blue image data latched by the third latch unit during the third period.

5. The data driver of claim 1, wherein each of the first through m-th output buffers includes:

a digital-to-analog converter (DAC) configured to convert an output signal from one of the first through m-th latches into an analog signal; and a voltage generator configured to generate one of the plurality of pixel voltages based on the analog signal.

6. A data driver comprising:

a shift register unit including first through m-th shift registers, the first shift register configured to shift and store first through n-th image data output from a timing controller, where n and m are natural numbers equal to or greater than two;

first through m-th latch units connected to the first through m-th shift registers, respectively, the first latch unit including first through n-th latches; and first through m-th output buffer units connected to the first through m-th latch units, respectively, the first output buffer unit including first through n-th output buffers, wherein the first through n-th latches are configured to sequentially latch the first through n-th image data stored in the first shift register, wherein one horizontal period is divided into first through n-th periods, wherein a j-th latch among the first through n-th latches included in the first latch unit is configured to latch j-th image data of the first through n-th image data stored in the first shift register during a j-th period among the first through n-th periods, where j is a natural number equal to or greater than one and equal to or less than n, and wherein a j-th output buffer among the first through n-th output buffers included in the first output buffer unit is configured to generate a pixel voltage based on the j-th image data latched by the j-th latch during the j-th period, wherein the first image data among the first through third image data stored in the first shift register when n is three and j is one corresponds to red image data applied to a red pixel configured to output red light, the first image data being processed during the first period among the first through third periods, wherein the second image data among the first through third image data stored in the first shift register when n is three and j is two corresponds to green image data applied to a green pixel configured to output green light, the second data being processed during the second period among the first through third periods, and wherein the third image data among the first though third image data stored in the first shift register when n is three and j is three corresponds to blue image data applied to a blue pixel configured to output blue light, the third data being processed during the third period among the first through third periods.

7. The data driver of claim 6, wherein an operating frequency of the data driver is n times greater than an operating frequency of a scan driver.

8. The data driver of claim 6, wherein the first latch among the first through third latches included in the first latch unit when n is three and j is one is configured to latch the red image data stored in the first shift register during the first period, wherein the second latch among the first through third latches included in the first latch unit when n is three and j is two is configured to latch the green image data stored in the first shift register during the second period, and wherein the third latch among the first through third latches included in the first latch unit when n is three and j is three is configured to latch the blue image data stored in the first shift register during the third period.

9. The data driver of claim 8, wherein the first output buffer among the first through third output buffers included in the first output buffer unit when n is three and j is one is configured to generate a first pixel voltage applied to the red pixel based on the red image data latched by the first latch during the first period, wherein the second output buffer among the first through third output buffers included in the first output buffer unit when n is three and j is two is configured to generate a second pixel voltage applied to the green pixel based on the green image data latched by the second latch during the second period, and wherein the third output buffer among the first through third output buffers included in the first output buffer unit when n is three and j is three is configured to generate a third pixel voltage applied to the blue pixel based on the blue image data latched by the third latch during the third period.

10. The data driver of claim 6, wherein the j-th output buffer includes:

a digital-to-analog converter (DAC) configured to convert an output signal from the j-th latch into an analog signal; and a voltage generator configured to generate the pixel voltage based on the analog signal.

11. A data driver comprising:

a shift register unit including first through m-th shift registers, the first shift register configured to shift and store first through n-th image data output from a timing controller, where n and m are natural numbers equal to or greater than two;

a latch unit including first through m-th latches, the first through m-th latches being connected to the first through m-th shift registers, respectively, wherein the first latch is configured to latch the first through n-th image data stored in the first shift register; and first through m-th output buffer units connected to the first through m-th latches, respectively, the first output buffer unit including first through n-th output buffers, where n is a natural number equal to or greater than two, wherein the first through n-th output buffers are configured to sequentially generate first through n-th pixel voltages, respectively, based on the first through n-th image data latched by the first latch, wherein one horizontal period is divided into first through n-th periods, and wherein a j-th output buffer among the first through n-th output buffers included in the first output buffer unit is configured to generate a pixel voltage based on one of the first through n-th image data latched by the first latch during a j-th period among the first through n-th periods, wherein the first image data among the first through third image data stored in the first shift register when n is three and j is one corresponds to a first pixel configured to output first color light, the first image data being processed during the first period among the first through third periods, wherein the second image data among the first through third image data stored in the first shift register when n is three and j is two corresponds to a second pixel configured to output second color light, the second image data being processed during the second period among the first through third periods, and wherein the third image data among the first through third image data stored in the first shift register when n is three and j is three corresponds to a third pixel outputting third color light, the third image data being processed during the third period among the first through third periods.

12. The data driver of claim 11, wherein an operating frequency of the data driver is n times greater than an operating frequency of a scan driver.

13. The data driver of claim 11, wherein the first output buffer among the first through third output buffers included in the first output buffer unit when n is three and j is one is configured to generate a first pixel voltage applied to the first pixel based on the first image data latched by the first latch during the first period, wherein the second output buffer among the first through third output buffers included in the first output buffer unit when n is three and j is two is configured to generate a second pixel voltage applied to the second pixel based on the second image data latched by the first latch during the second period, and wherein the third output buffer among the first through third output buffers included in the first output buffer unit when n is three and j is three is configured to generate a third pixel voltage applied to the third pixel based on the third image data latched by the first latch during the third period.

14. The data driver of claim 11, wherein the j-th output buffer includes:

a digital-to-analog converter (DAC) configured to convert an output signal from the first latch into an analog signal; and a voltage generator configured to generate the pixel voltage based on the analog signal.

15. A data driver configured to receive a first plurality of image data through an n-th plurality of image data and to generate a first plurality of pixel voltages through an n-th plurality of pixel voltages, wherein n is a natural number of at least two, the data driver comprising:

a plurality of registers, a first register of the plurality of registers configured to shift and store image data selected from each of the first plurality of image data through the n-th plurality of image data;

a plurality of latch units, a first latch unit of the plurality of latch units configured to latch the stored image data selected from each of the first plurality of image data through the n-th plurality of image data; and a plurality of output buffer units, a first output buffer unit of the plurality of output buffer units including first through n-th output buffers, wherein the first through n-th output buffers are configured to sequentially generate the first plurality of pixel voltages through the n-th plurality of pixel voltages, respectively, based on the latched image data selected from each of the first plurality of image data through the n-th plurality of image data, wherein the first plurality of pixel voltages through the n-th plurality of pixel voltages correspond to different color image data, respectively, wherein one horizontal period is divided into first through n-th periods, and wherein the first output buffer unit is configured to generate a pixel voltage based on one of the first through n-th image data latched by the first latch unit during a j-th period among the first through n-th periods, wherein the first image data stored in the first shift register when n is three and j is one corresponds to a first pixel configured to output first color light, the first image data being processed during the first period among the first through third periods, wherein the second image data stored in the first shift register when n is three and j is two corresponds to a second pixel configured to output second color light, the second image data being processed during the second period among the first through third periods, and wherein the third image data stored in the first shift register when n is three and j is three corresponds to a third pixel outputting third color light, the third image data being processed during the third period among the first through third periods.

* * * * *